United States Patent [19]

Morey

[11] 4,321,899

[45] Mar. 30, 1982

[54] FLUID DEVICE FOR VEHICLE FUEL CONSUMPTION ENHANCEMENT

[76] Inventor: Robert E. Morey, 18 Cumberland Rd., Hamilton Square, N.J. 08690

[21] Appl. No.: 147,974

[22] Filed: May 8, 1980

[51] Int. Cl.[3] ..... F02D 11/08

[52] U.S. Cl. ..... 123/319; 123/325; 123/377; 123/396; 123/389; 123/401

[58] Field of Search ..... 123/389, 396, 401, 370, 123/371, 198 D, 198 DB, 325, 377, 319

[56] References Cited

U.S. PATENT DOCUMENTS

| | | | |
|---|---|---|---|
| 2,910,974 | 11/1959 | Caris | 123/377 |
| 3,918,320 | 11/1975 | Glick, Jr. | 74/513 |
| 4,016,842 | 4/1977 | Kitther | 123/319 |
| 4,077,370 | 3/1978 | Spangenberg | 123/401 |
| 4,084,561 | 4/1978 | Miller | 123/389 |
| 4,094,281 | 6/1978 | Kitther | 123/319 |
| 4,117,809 | 10/1978 | Kitther | 123/319 |
| 4,156,405 | 5/1979 | Franke | 123/325 |
| 4,210,110 | 7/1980 | Krebaum et al. | 123/396 |
| 4,270,501 | 6/1981 | Broen et al. | 123/396 |
| 4,274,377 | 6/1981 | Kraw, Jr. | 123/396 |

FOREIGN PATENT DOCUMENTS

| | | | |
|---|---|---|---|
| 197675 | 5/1936 | Fed. Rep. of Germany | 123/370 |
| 2547385 | 4/1977 | Fed. Rep. of Germany | 123/396 |

*Primary Examiner*—Raymond A. Nelli

*Attorney, Agent, or Firm*—John J. Kane; Frederick A. Zoda; Albert Sperry

[57] ABSTRACT

A fluid device for vehicle fuel consumption enhancement including a body defining a compressible chamber therein the body is connected to the throttle linkage to be compressed responsive to movement of the vehicle throttle in the acceleration direction, the chamber housing a fluid therein which is adapted to be expelled through a fluid bleed orifice upon compression of the chamber to control the force of movement of the vehicle throttle, the bleed being preferably variable to control the speed of movement of the vehicle throttle, the device further including a fluid return providing a means for the return of the expelled fluid back into the chamber upon the deceleration of the vehicle throttle and further including a safety valve positioned in fluid flow communication with the chamber and adapted to allow instantaneous expelling of substantially all of the fluid from the chamber responsive to a predetermined large amount of force being exerted against the vehicle throttle and thereby against the compressible chamber in order to provide an override capability in cases of emergency, the device being particularly usable in two configurations wherein one utilizes air as the fluid and has a compressible bellows as the compressible chamber wherein the other embodiment includes oil or other liquid as the fluid including a piston and fixed walled enclosure for defining the compressible chamber.

21 Claims, 4 Drawing Figures

FLUID DEVICE FOR VEHICLE FUEL CONSUMPTION ENHANCEMENT

BACKGROUND OF THE INVENTION

1. Field of the Invention

The present invention deals with the field of devices for controlling the acceleration, not the speed, of vehicles in particular cars and trucks. By so controlling the acceleration capability the present device will provide a biofeedback-type control thereof which will substantially enhance gas mileage by preventing jack-rabbit starts and other high accelerating operations of motor vehicles.

With the high costs of vehicle fuels currently marketed a device which continually reminds the vehicle operator to minimize acceleration to minimize gas consumption is desirable.

2. Description of the Prior Art

Many prior art devices are directed particularly to govern throttle operation of motor vehicles. Most of these devices are directed to limiting speed rather than only limiting acceleration. The present invention provides a novel means of limiting acceleration only while not limiting overall speed while at the same time providing a safety valve to allow instant overriding of the acceleration control device to allow for emergency accelerating conditions which might occur.

SUMMARY OF THE INVENTION

The present invention provides a fluid device for controlling the operation of a motor vehicle accelerator pedal and thereby improving fuel consumption characteristics. The basic device includes a body which defines a compressible chamber means therein. The body is connected to the vehicle throttle linkage such that when the vehicle throttle is moved in the acceleration direction the chamber will be compressed.

The chamber will be filled with a fluid such as air which will be expelled from the chamber responsive to movement of the vehicle throttle in the acceleration direction due to the resulting compression exerted by the vehicle accelerator against the chamber means. This expelling of the fluid means is performed through a fluid bleed means which is positioned in fluid flow communication with the interior of the compressible chamber means. In this way the bleed means controls the release of the fluid means from the compressible chamber means during compression thereof. In this manner rapid downward movement of the accelerator pedal will be discouraged. It has been found that with most cars an acceleration from 0 to 30 miles per hour in ten seconds maximizes fuel savings and this device is useful to help a driver stay close to this acceleration rate.

The device further includes a fluid return means which is positioned in fluid flow communication with the interior of its compressible chamber and is adapted to allow the return of expelled fluid into the chamber and also to prevent the flow of fluid out of the chamber through the fluid return means. That is, the flow of fluid outward from the chamber must occur through the fluid bleed means and not through the fluid return means. The device further includes a safety valve means which is positioned in fluid flow communication which is positioned in fluid flow communication with the interior of the compressible chamber and is adapted to allow the instantaneous exhausting of substantially all of the fluid means from the compressible chamber responsive to a predetermined large amount of force being exerted against the vehicle accelerator. This safety valve configuration creates an emergency overdrive which might be required if rapid vehicle acceleration must occur during emergency situations and the like. Preferably the safety valve means and the fluid bleed means are both adjustable in order to control the predetermined force required to blow out the safety valve means and to control the release of fluid through the fluid bleed means.

The device further includes an override sensing means which is adapted to generate an override signal responsive to the flow of the fluid means through the safety valve means. Also, an override indicator means will be utilized to be adapted to receive the override signal and display this condition of override in an area which is easily viewable by the vehicle operator. The override indicator means could be visual and aural or another type of display-type device.

In one embodiment the walls of the body will be formed as bellows out of a soft plastic material to allow collapsing of the body during compression of the chamber means as a result of vehicle acceleration. In this configuration the fluid means will be air and preferably the fluid bleed means, the fluid return means and the safety valve will all be located in the top surface of the body. Also, a dust protective covering filter means will enclose the top surface of the body to prevent dust and other contaminants from fouling the various valves. This device is adapted to be placed under the vehicle accelerator pedal in order to be compressed directly by the pedal during acceleration and thereby control the acceleration.

In another embodiment the body will define a fixed walled enclosure or cylinder which includes a piston means therein which is movable from an opened position to a closed position to vary the size of the collapsible chamber therein. In other words, the chamber will collapse in response to the movement of the piston in the closing direction which in turn is responsive to movement of the accelerator pedal in the acceleration direction. With this configuration the fluid means will be some type of liquid preferably such as oil or the like.

This liquid embodiment will include an exhaust conduit in fluid flow communication with the compressible chamber to allow exhausting of the liquid from the chamber as well as including a fluid reservoir also in fluid flow communication with the exhaust conduit.

The fluid bleed means itself will be located within the exhaust conduit to control the flow of fluid therethrough into the reservoir and to prevent reverse flow. Also, an intake conduit will be located in fluid flow communication with the compressible chamber and the reservoir to allow the return of the expelled liquid back from the chamber and this intake conduit will include the fluid return means positioned therein to allow the liquid to return to the chamber to prevent expelling of the fluids through the intake conduit. Preferably the reservoir will include a vent means. Also the configuration will include a parallel conduit connecting to the exhaust conduit both upstream and downstream of the fluid bleed means to thereby provide a bypass thereof. The safety valve means will be positioned within the parallel conduit to provide this overriding capability to the vehicle operator for emergency conditions.

It is an object of the present invention to provide a fluid device for improving vehicle fuel consumption which will actually provide an improvement in gas mileage of as high as 25 to 30 percent.

It is an object of the present invention to provide a fluid device for improving vehicle fuel consumption which includes a safety device for allowing driver override in emergency situations.

It is an object of the present invention to provide a fluid device for improving vehicle fuel consumption which controls the downwardly directed pressure on an accelerator pedal to limit acceleration but without limiting actual top speed.

It is an object of the present invention to provide a fluid device for improving vehicle fuel consumption which includes a means for varying the speed of acceleration.

It is an object of the present invention to provide a fluid device for improving vehicle fuel consumption by modifying driver behavior responsive to aural and/or visual biofeedback.

It is an object of the present invention to provide a fluid device for improving vehicle fuel consumption by modifying driver behavior responsive to the biofeedback of pressures exerted against the accelerator pedal.

It is an object of the present invention to provide a fluid device for improving vehicle fuel consumption which is particularly usable with cars equipped with automatic transmissions.

It is an object of the present invention to provide a fluid device for improving vehicle fuel consumption which minimizes rapid acceleration from a standing start or while already traveling at a given speed.

It is an object of the present invention to provide a fluid device for improving vehicle fuel consumption which substantially increases tire mileage.

It is an object of the present invention to provide a fluid device for improving vehicle fuel consumption which substantially decreases air pollution by minimizing rapid acceleration of motor vehicles.

It is an object of the present invention to provide a fluid device for improving vehicle fuel consumption which substantially reduces mechanical repairs by limiting vehicle acceleration.

It is an object of the present invention to provide a fluid device for improving vehicle fuel consumption which reduces driver anxiety.

It is an object of the present invention to provide a fluid device for improving vehicle fuel consumption which provides a continuous reminder for minimizing rapid acceleration to maximize gas mileage.

It is an object of the present invention to provide a fluid device for improving vehicle fuel consumption which may be simply and easily put in place beneath the presently existing accelerator pedal of most motor vehicles.

It is an object of the present invention to provide a fluid device for improving vehicle fuel consumption which may be conveniently attached to the throttle linkage of presently existing motor vehicles within the engine compartment.

It is an object of the present invention to provide a fluid device for improving vehicle fuel consumption which may be secured under the dashboard of a standard motor vehicle and secured to the accelerator pedal therebelow by an attaching wire means or rod means.

It is an object of the present invention to provide a fluid device for improving vehicle fuel consumption which provides a sensing and indicator means for showing the actuation of the safety valve override system such that the driver will know when the safety valve has been actuated.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
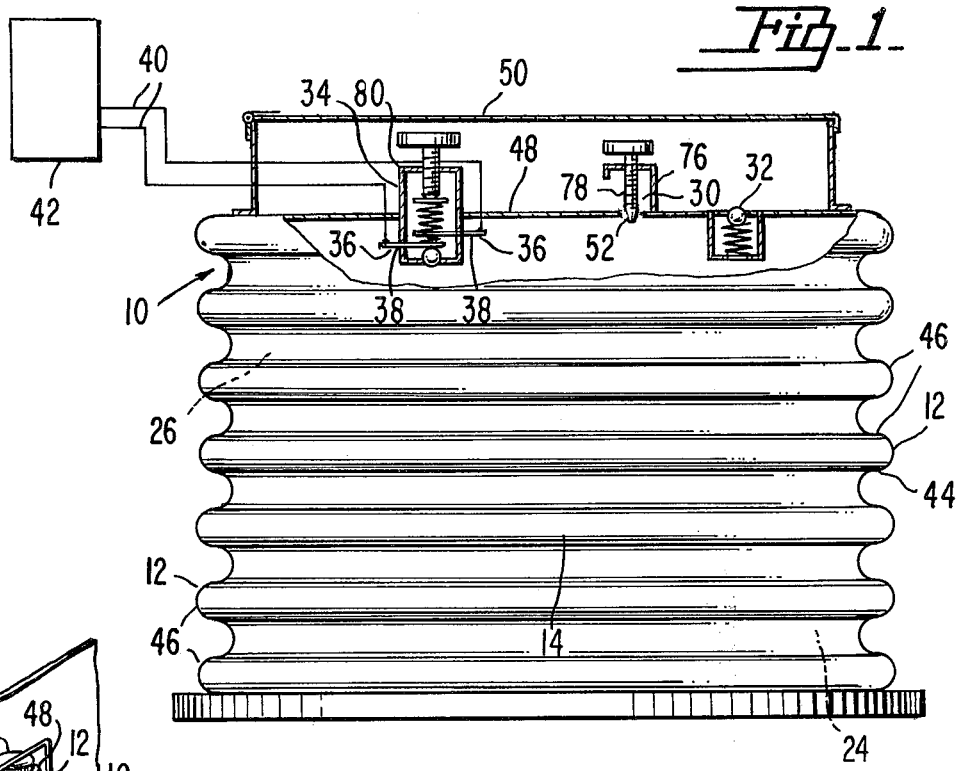
FIG. 1 is a cross-sectional view of an embodiment of the fluid device of the present invention showing the soft bellows body configuration.

The present invention provides a fluid device 10 which enhances vehicle fuel consumption by limiting the acceleration characteristics of the vehicle. The device 10 includes a body 12 which defines therein a compressible chamber means 14 which is responsive to be compressed whenever the vehicle throttle 16 is moved in the acceleration direction. This interconnection between the compressible chamber means 14 and the vehicle can be made directly attached to the throttle linkage 17 or specifically attached to the accelerator pedal 18. In this manner when the accelerator is moved in the acceleration direction as shown by arrow 20 the chamber will be compressed. On the other hand when the throttle is moved in the non-accelerating direction shown by arrow 22 the compressible chamber means 14 will be expanded. This expanding can result from the resilience of the material from which the chamber means 14 is made or can be introduced by placement of a spring-like device therein or thereon.

Figure 2:
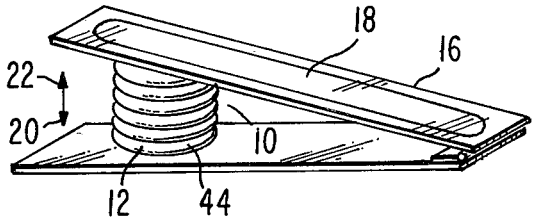
FIG. 2 is a perspective illustration of an embodiment of the device shown in FIG. 1 wherein it is shown in place beneath a vehicle accelerator pedal.
Figure 3:
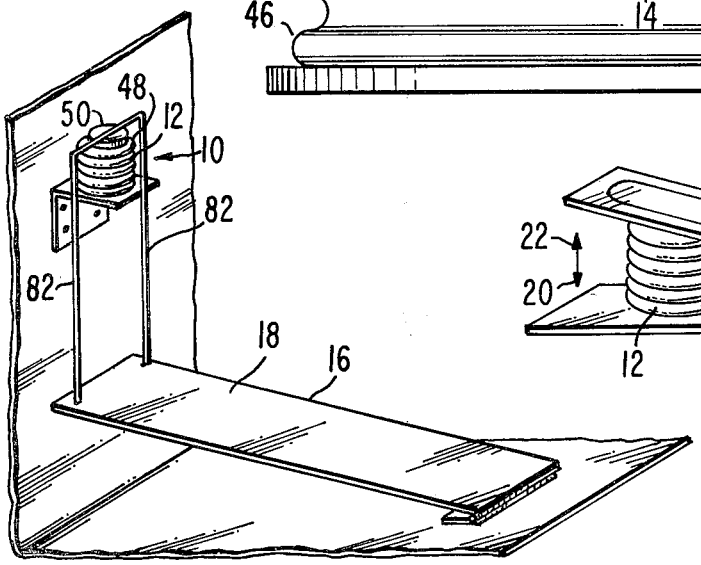
FIG. 3 is a perspective illustration of an embodiment of the fluid device of the present invention shown secured beneath a vehicle dashboard and connected to the accelerator pedal therebelow.

To facilitate control of movement of the throttle 16 in the acceleration direction 20 a fluid means 24 will be located within the compressible chamber means 14. This fluid means may take the form of air 26 as shown in the configurations of FIGS. 1, 2 and 3 or may take the form of a liquid such as oil 28 in the configuration shown in FIG. 4. Under either system, a fluid bleed means 30 is positioned in fluid flow communication with the interior of the compressible chamber means such that it is adapted to control the release of the fluid 24 from the chamber 14. This fluid bleed means 30 will be the only avenue of escape for the fluid means 24 from the compressible chamber means 14 and as such by accurate control of the sizing of the fluid bleed means 30 the amount of acceleration possible when utilizing the present device 10 will be controllable.

In the system utilizing air 26 as shown in FIG. 1 this fluid bleed means 30 will take the form of an orifice 52 in an appropriate area such as the top surface 48 of body 12. A bracket 76 will be positioned to hold an adjustable needle member 78 in direct proximity to the orifice 52. Merely by rotating of the needle which is threaded into the bracket 76 the available cross-sectional area of the orifice 52 may be controlled and as such the total speed of flow of the fluid means 24 through the fluid bleed means 30 will be controlled adjustably thereby.

When the accelerator pedal is moved in the non-acceleration direction as shown by arrow 22 it will be necessary to provide a means for return of the fluid means 24 into the chamber 14. For this purpose a fluid return means 32 may be included in the present invention which comprises generally a one-way valve means which prevents the expelling of air through the fluid return means 32 outwardly from the chamber 14 but, on the other hand, which allows the free intake of air into chamber 14 during expansion thereof. In the system utilizing air 26 as shown in FIG. 1 this fluid return means 32 may take the form of a spring mounted ball which is adapted to allow the air to pass inwardly but which will prevent the air from passing outwardly therethrough.

The device 10 further includes a safety valve means 34 which is adaptable to provide an override capability to the action of the present device such that in an emergency situation the controlled bleeding of fluid 24 through the orifice 52 may be bypassed to allow complete collapsing of the chamber 14 if desired. In such emergency circumstances when the operator will move the vehicle throttle 16 rapidly and forcefully the extreme pressure created by collapsing of the chamber means 14 will cause the safety valve means to become actuated and allow complete exhausting of fluid means 24 through the safety valve 34. This may be necessary when the vehicle must be immediately accelerated to avoid a danger situation on the highway, for example. In the system utilizing air 26 as shown in FIG. 1 of the present invention this safety valve means 34 may take the form of a movable thumb screw which may adjustably vary the pressure of a spring downwardly on a ball positioned within an orifice. This is a one-way valve allowing the fluid to escape from the chamber 14 but preventing the fluid from entering the chamber from outside thereof. Also, this device would be adjustable since the bracket 80 will provide a mounting means for the variable positioning of the threaded member to thereby control the amount of force exerted downwardly on the ball by the spring and thereby vary the predetermined required force for activation of the safety valve means 34.

Safety valve means 34 may also be provided with an override sensing means 36 which is adapted to send a signal from perhaps override contacts 38 to an override display 42 through lines 40. In this manner whenever the safety valve means 34 is actuated the override sensing means 36 will generate the override signal and cause the override display 42 to indicate in a convenient manner that the safety valve means 34 has been actuated in the fluid device 10 of the present invention. Override display 42 may be a visual means such as an indicator light or an aural means such as a buzzer. In this manner the operator of the vehicle will know whenever he has exceeded the predetermined value of the safety valve means 34.

In the configuration using air 26 the walls 44 of body 12 will be formed of a soft plastic material in the form of bellows 46. In this manner when the accelerator is moved in the vehicle acceleration direction 20 the bellows 46 will collapse and compress the chamber means 14. With this configuration it is desirable to include a dust protective covering filter means 50 over the top surface of the body 12. Also it is particularly useful with this configuration to include the fluid bleed means 30, the fluid return means 32 and the safety valve means 34 in the top surface 48 of body 12 such that the filter means 50 may prevent contamination of these devices.

In the operation of the configuration shown in FIG. 1 when the body 12 is placed beneath the accelerator pedal 18 and when the accelerator pedal is moved in the acceleration direction 20 the bellows 46 will start to collapse. This movement is due to the fact that the fluid means 24 will be moving outwardly through the orifice 52 of the fluid bleed means 30. Simultaneously the fluid return means 32 will be locked in the closed position since the ball therein will be urged upwardly into the orifice. Also the safety valve means 34 will be in a ready condition such that is capable of being actuated if the downwardly exerted pressure on the body 12 exceeds the predetermined set value of the spring or other biasing means positioned within the safety valve means 34. Once the vehicle has reached the desired speed the acceleration will cease.

When deceleration is required the accelerator pedal 18 will be moved in the non-acceleration direction 22 and the air 26 will be allowed to return into the chamber 14 primarily through the fluid return means 32. Also some air will be allowed to pass back into the chamber through the bleed means 30 however this will be insignificant compared with the larger volume of air which will flow through the fluid return means 32. In this manner a final functioning device has been provided by the configuration shown in FIG. 1 which includes the safety means as well as a bleeding and returning means for the fluid therein. It may also be possible to utilize this device having air 26 as the fluid means 24 wherein the body 12 is not placed under the accelerator pedal. This configuration as shown in FIG. 3 wherein the accelerator pedal is connected to the body 12 by way of rods or wires 82. In this manner the same complete theory of actuation is used however the device 10 itself is not placed directly under the accelerator pedal.

Figure 4:
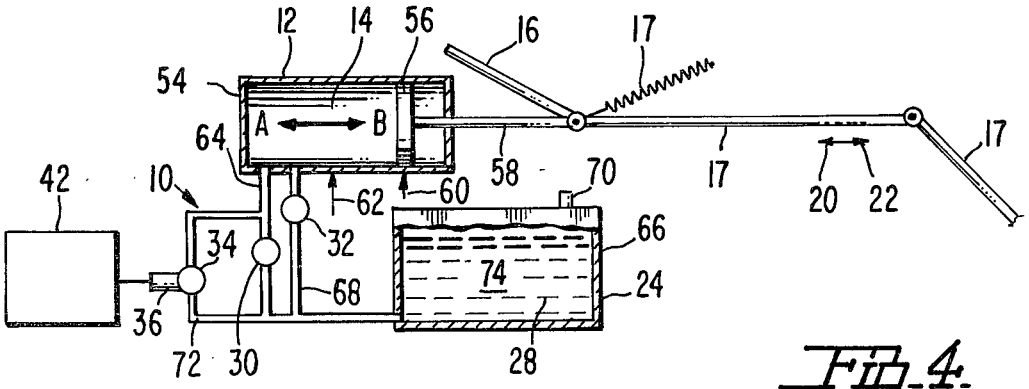
FIG. 4 is a diagramatical illustration of an embodiment of the fluid device of the present invention utilizing the body comprising the fixed walled enclosure having a piston means therein.

In an alternative preferred embodiment as shown in FIG. 4 a fixed walled enclosure 54 is utilized with a movable piston means 56 therein. The head area of the movable piston means as well as the inside walls of the fixed wall enclosure 54 will define the compressible chamber means 14. The piston means itself is connected by way of a piston shaft 54 to the throttle linkage 17 of the motor vehicle. This piston is thereby movable from position 60 which is the opened position to position 62 which is the closed position. Closed position 62 corresponds to the collapsed condition of the compressible chamber means 14 and, similarly, opened position 60 corresponds to the fully expanded position of the compressible chamber means 14.

With this configuration it is preferable to use a liquid 28 as the fluid means 24 and is most preferable to use an oil type liquid 74 or a synthetic such oil. In order to allow the exhausting of oil 74 from the chamber in a controlled fashion an exhaust conduit 64 is included which is in fluid flow communication with the compressible chamber means 14 as well as being in fluid flow communication with a fluid reservoir 66. The fluid reservoir 66 provides the holding location for oil 74 which has been expelled from the chamber 14 by vehicle acceleration. In order to control the exhausting of oil 74 through the exhaust conduit 64 the fluid bleed means 30 will be positioned therein. This may take the form of a variable sized orifice to control the exhausting of oil 74.

In order to allow for the return of oil from the reservoir 66 back to the compressible chamber means 14 an intake conduit 68 may be included in the configuration shown in FIG. 4. This intake conduit may include the fluid return means 32 therein which is basically a one-way valve which prevents the flow of fluid outwardly from the chamber 14 but allows full and free flow of fluid from the reservoir 66 back into the chamber 14. Reservoir 66 preferably includes a vent means to prevent pressure build-up within the reservoir.

This embodiment shown in FIG. 4 also may preferably include a parallel conduit 72 which is connected to the exhaust conduit both upstream of and downstream of the fluid bleed means to bypass same. This parallel conduit may include therein the safety valve means which provides the override capability for usage by the vehicle operator during emergency conditions. In other words, when the throttle is urged in the accelerating position in a rapid and forceful fashion the controlled release of oil 74 from the chamber 14 through the fluid bleed means 30 will be overridden by the release of safety valve means 34 responsive to the excessive pressure exerted thereon. Also this configuration may include an override sensing means 36 which is adapted to communicate the overriding condition to an override display 42 located in an area easily perceivable to the vehicle operator. In this manner the configuration shown in FIG. 4 will present an alternative more expensive but a slightly more efficiently operating configuration than the simple device shown in FIG. 1. The device shown in FIG. 4 is somewhat more accurate and efficient since the usage of a liquid such as oil 74 within the compressible chamber will not itself be compressed. That is, the liquid actually cannot be compressed itself however the usage of a gaseous means as the fluid means 24 will allow compression of the gas and therefore more lag time between actual throttle movement and the initial expelling of gases from the chamber 14.

The configuration shown in FIG. 1 is conceived to be a device which is after-market such as can be installed by an individual on his own car. On the other hand, the configuration of the device shown in FIG. 4 is anticipated to be an original equipment manufactured device possibly included as an option on cars when ordered from the factory. It should be further appreciated that the FIG. 1 device could be an original equipment install device and the FIG. 4 device could be an after-market bolt on type device if this operation is performed by a mechanic.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A fluid device for vehicle fuel consumption enhancement comprising:

(a) a body defining a compressible chamber means therein connected to the vehicle throttle linkage, said chamber means adapted to be compressed directly proportional to movement of the vehicle throttle in the acceleration direction;

(b) fluid means located within said compressible chamber means and adapted to be expelled therefrom responsive to movement of the vehicle throttle in the acceleration direction and the resulting compression of said chamber means;

(c) fluid bleed means positioned in fluid flow communication with the interior of said compressible chamber means and adapted to allow controlled release of said fluid means from said chamber;

(d) fluid return means positioned in fluid flow communication with the interior of said compressible chamber and adapted to allow return of the expelled fluid into said chamber and to prevent the flow of fluid out of said chamber; and (e) safety valve means positioned in fluid flow communication with the interior of said compressible chamber and adapted to allow instantaneous expelling of substantially all of said fluid means from said compressible chamber means responsive to the existence of greater than a predetermined force being exerted by said fluid means against said safety valve means outward from the interior of said chamber as a result of compressing of said chamber means.

2. The device as defined in claim 1 wherein said safety valve means is adjustable.

3. The device as defined in claim 1 wherein fluid bleed means is adjustable.

4. The device as defined in claim 1 further including override sensing means attached to said safety valve means and adapted to generate an override signal responsive to the flow of said fluid means through said safety valve means.

5. The device as defined in claim 4 further including an override indicator means adapted to receive said override signal and display the override condition in an area easily perceivable to the vehicle operator.

6. The device as defined in claim 1 wherein said body includes walls formed as bellows to allow collapsing of said body during compression of said chamber means during vehicle acceleration.

7. The device as defined in claim 6 wherein said fluid means is air.

8. The device as defined in claim 7 wherein said walls are formed of a soft plastic material.

9. The device as defined in claim 7 wherein said fluid bleed means, said fluid return means and said safety valve means are located on the top surface of said body, the top surface being generated flat and enclosed by a dust protective covering filter means adapted to prevent the flow of dust and other contaminants from the external environment to said fluid bleed means, said fluid return means and said safety valve means.

10. The device as defined in claim 6 wherein said body is adapted to be placed directly under the existing accelerator pedal of a vehicle to control acceleration thereof.

11. The device as defined in claim 6 further including an accelerator pedal means, the bottom of which is secured to the top of said body such that the existing accelerator pedal of the vehicle is replaced.

12. The device as defined in claim 1 wherein said fluid bleed means comprises an orifice.

13. The device as defined in claim 1 wherein said body comprises a fixed walled enclosure and a piston means movable therein from an opened position to a closed position responsive to the movement of the vehicle accelerator, the interior walls of said enclosure and said piston defining said chamber means wherein said chamber is compressible by movement of said piston means between the opened and closed position.

14. The device as defined in claim 13 wherein said fluid means is liquid.

15. The device as defined in claim 13 further including an exhaust conduit in fluid flow communication with said compressible chamber to allow exhausting of fluid means from said chamber, and a fluid reservoir also in fluid flow communication with said exhaust conduit, said fluid bleed means being located within said exhaust conduit to control the flow of fluid means therethrough into said reservoir and to prevent reverse flow.

16. The device as defined in claim 15 further including an intake conduit in fluid flow communication with said compressible chamber and said reservoir to allow return of expelled fluid back into said chamber, said intake conduit including said fluid return means therein to allow fluid means to return to said chamber and to prevent expelling of fluid means through said intake conduit.

17. The device as defined in claim 16 wherein said reservoir includes a vent means.

18. The device as defined in claim 15 including a parallel conduit connecting to said exhaust conduit on each side of said fluid bleed means, said safety valve means being located within said parallel conduit to provide an override capability to the vehicle operation for emergency situations.

19. The device as defined in claim 13 wherein said fluid means is oil.

20. A fluid device for a vehicle fuel consumption enhancement comprising:

(a) a body defining a compressible chamber means therein connected to the vehicle throttle linkage, said chamber means adapted to be compressed directly proportional to movement of the vehicle throttle in the acceleration direction, said body including valve means being adjustable to vary the predetermined force required to induce instantaneous expelling of said fluid means;

(f) override sensing means attached to said safety valve means and adapted to generate an override signal responsive to the flow of said fluid means through said safety valve means;

(g) override indicator means adapted to receive said override signal and display the override condition in an area easily perceivable to the vehicle operator; and (h) a dust protective covering filter means positioned over the top surface of said body, said fluid bleed means, said fluid return means, and said safety valve means each being located on the top surface of said body to be protected from exterior contaminants by said dust protective covering filter means.

21. A fluid device for vehicle fuel consumption enhancement comprising:

(a) a body defining a compressible chamber means therein connected to the vehicle throttle linkage, said chamber means adapted to be compressed directly proportional to movement of the vehicle throttle in the acceleration direction, said body comprising a fixed walled enclosure and a piston means being movable therein from an opened position to a closed position responsive to movement of the vehicle accelerator, the interior walls of said enclosure and said piston defining walls formed as bellows to allow collapsing of the bellows during compression of said compressible chamber during vehicle acceleration;

(b) fluid means located within said compressible chamber means and adapted to be expelled therefrom responsive to movement of the vehicle throttle in the acceleration direction and the resulting compression of said chamber means, said fluid means comprising air;

(c) adjustable fluid bleed means comprising an orifice positioned on the top of said body in fluid flow communication with the interior of said compressible chamber means and adapted to allow controlled release of said fluid means from said chamber;

(d) fluid return means positioned on the top side of said body in fluid flow communication with the interior of said compressible chamber and adapted to allow return of expelled fluid into said chamber and to prevent the flow of fluid out of said chamber;

(e) safety valve means positioned on the top side of said body in fluid flow communication with the interior of said compressible chamber and adapted to allow instantaneous expelling of substantially all of said fluid means from said compressible chamber means responsive to the existence of greater than a predetermined force being exerted by said fluid means against said safety valve means outward from the interior of said chamber as a result of compressing of said chamber means, said safety said chamber means wherein said chamber is compressible by movement of said piston means between the opened and the closed positions;

(b) fluid means located within said compressible chamber and adapted to be expelled therefrom responsive to movement of the vehicle throttle in the acceleration direction and the resulting compression of said chamber means;

(c) adjustable fluid bleed means positioned in fluid flow communication with the interior of said compressible chamber means and adapted to allow controlled release of said fluid means from said chamber;

(d) fluid return means positioned in fluid flow communication with the interior of said compressible chamber and adapted to allow return of expelled fluid into said chamber and to prevent the flow of fluid out of said chamber;

(e) safety valve means positioned in fluid flow communication with the interior of said compressible chamber and adapted to allow instantaneous expelling of substantially all of said fluid means from said compressible chamber means responsive to the existence of greater than a predetermined force being exerted by said fluid means against said safety valve means outward from the interior of said chamber as a result of compressing of said chamber means, said safety valve means being adjustable to vary the predetermined force required to induce instantaneous expelling of said fluid means; and (h) an exhaust conduit in fluid flow communication with said compressible chamber to allow exhausting of fluid means from said chamber, and a fluid reservoir also in fluid flow communication with said exhaust conduit, said variable fluid bleed means being located within said exhaust conduit to control the flow of said fluid means therethrough into said reservoir and to prevent reverse flow;

(i) an intake conduit in fluid flow communication with said compressible chamber and said reservoir to allow return of expelled fluids back into said chamber, said intake conduit including said fluid return means therein to allow fluid means to return to said chamber to prevent expelling of fluids through said intake conduit; and (j) a parallel conduit connected to said exhaust conduit on each side of said fluid bleed means to bypass same, said safety valve means being located within said parallel conduit to provide an override capability to the vehicle operation for emergency conditions.

* * * * *

UNITED STATES PATENT AND TRADEMARK OFFICE

CERTIFICATE OF CORRECTION

PATENT NO. : 4,321,899

DATED : May 28, 1982

INVENTOR(S) : Robert E. Morey

It is certified that error appears in the above—identified patent and that said Letters Patent is hereby corrected as shown below:

Column 9, line 68, the words "walls formed as" through column 10, line 32 completely should be inserted into column 9, line 40, after the word "including", and before the word "valve".

Signed and Sealed this

*Twentieth* Day of *July 1982*

[SEAL]

*Attest:*

GERALD J. MOSSINGHOFF

*Attesting Officer*

*Commissioner of Patents and Trademarks*